US007111559B1

(12) United States Patent
MacLachlan

(10) Patent No.: US 7,111,559 B1
(45) Date of Patent: Sep. 26, 2006

(54) MOBILE ELECTRICAL DEVICE FOR DISABLING A MOVING VEHICLE

(76) Inventor: Edward K. MacLachlan, 47 Anderson Ave., Middleboro, MA (US) 02346

( * ) Notice: Subject to any disclaimer, the term of this patent is extended or adjusted under 35 U.S.C. 154(b) by 257 days.

(21) Appl. No.: 10/891,294

(22) Filed: Jul. 15, 2004

(51) Int. Cl.
*F42B 30/00* (2006.01)

(52) U.S. Cl. ..... 102/502; 89/1.11; 361/232

(58) Field of Classification Search ..... 102/258, 102/259, 260, 261, 262, 264, 293, 395, 444, 102/498, 501, 502, 513, 514, 529; 89/1.11; 361/230, 231, 232, 233, 235; 452/58
See application file for complete search history.

(56) References Cited

U.S. PATENT DOCUMENTS

| | | | | | |
|---|---|---|---|---|---|
| 3,523,538 | A | | 8/1970 | Shimizu | |
| 3,626,626 | A | * | 12/1971 | Blanc | 43/6 |
| 3,803,463 | A | * | 4/1974 | Cover | 361/232 |
| 4,218,525 | A | * | 8/1980 | Selgin | 429/114 |
| 4,253,132 | A | * | 2/1981 | Cover | 361/232 |
| 4,678,437 | A | * | 7/1987 | Scott et al. | 434/21 |
| D299,507 | S | | 1/1989 | Hwa | |
| 5,473,501 | A | | 12/1995 | Claypool | |
| 5,698,815 | A | * | 12/1997 | Ragner | 102/502 |
| 5,952,600 | A | | 9/1999 | Herr | |
| 5,962,806 | A | * | 10/1999 | Coakley et al. | 102/502 |
| 6,269,726 | B1 | | 8/2001 | McNulty, Sr. | |
| 6,371,000 | B1 | | 4/2002 | Hutmacher et al. | |
| 6,636,412 | B1 | * | 10/2003 | Smith | 361/232 |
| 6,679,180 | B1 | * | 1/2004 | Warnagiris et al. | 102/502 |
| 6,802,261 | B1 | * | 10/2004 | Warnagiris et al. | 102/502 |
| 6,802,262 | B1 | * | 10/2004 | Warnagiris et al. | 102/502 |
| 6,862,994 | B1 | * | 3/2005 | Chang | 102/502 |
| 6,877,434 | B1 | * | 4/2005 | McNulty, Jr. | 102/502 |
| 6,880,466 | B1 | * | 4/2005 | Carman | 102/502 |
| 7,042,696 | B1 | * | 5/2006 | Smith et al. | 361/232 |

FOREIGN PATENT DOCUMENTS

| | | | |
|---|---|---|---|
| DE | 4028874 | * | 3/1992 |
| DE | 19819351 | * | 11/1999 |
| EP | 0709646 | * | 5/1996 |
| JP | 2-267369 | * | 11/1990 |

* cited by examiner

*Primary Examiner*—Peter M. Poon
*Assistant Examiner*—David Parsley

(57) ABSTRACT

A projectile for being launched from a hand-operable air gun includes a housing having a conductive sleeve and a rubber seal disposed at an end portion thereof. The device includes a strike plate including a conductive contact ring having apertures randomly spaced therethrough and spike members electrically coupled thereto. A conductive tip is attachable to the housing and includes flange portions extending therefrom. The device further includes a mechanism for oscillating the strike plate and a power supply source electrically coupled to the tip and the strike members respectively. The tip distributes a positive charge to the target and the strike members distribute a negative charge to the target, inducing a short circuit and thereby disabling an electronic control module of the target upon impact.

18 Claims, 3 Drawing Sheets

MOBILE ELECTRICAL DEVICE FOR DISABLING A MOVING VEHICLE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a vehicle disabling device and, more particularly, to a mobile electrical device for disabling a moving vehicle.

2. Prior Art

To this date, the known non-lethal and sub-lethal electrical weapons that have been designed to render a target subject less than completely functional have relied on low-frequency, high-voltage currents to shock, stun, or disorient the target subject.

One device is a handheld weapon from which two small projectiles are fired at the target subject. Each projectile is attached to a fine conductive wire so as to deliver an electrical current to stun the target subject. The principal drawback of this type of device is that it cannot be used against a suspect that is fleeing in a car. The weapon is thus of little value if it must be used against a moving vehicle. Further, the weapon is classified as a firearm because the projectiles are propelled by nitrocellulose powder charges, and it is therefore subject to all the legal restrictions applied to firearms.

In volatile situations, it is desirable to effectively calm the individual without risking injury to others, especially those proximate to the situation, while using reasonable force against the individual. There are many prior art devices available which can be implemented by law enforcement personnel, each appropriate for a given situation. Tear gas is one such example.

In the case of a police chase, however, the officer(s) are usually forced to use drastic measures such forcing the car off the road with their own vehicle, laying down spike strips to disable the fleeing vehicle, or shoot out the fleeing vehicle's tires, thus disabling it. These measures all present a threat to the police officer(s), the fleeing criminal, and most importantly, to the public.

Accordingly, a need remains for a mobile electrical device for disabling a moving vehicle. The present invention satisfies such a need by providing a device that is easy and safe to use prior to and during a high-speed chase. The device disables a criminal's car, eliminating the dangerous high-speed chase that might have ensued otherwise.

BRIEF SUMMARY OF THE INVENTION

In view of the foregoing background, it is therefore an object of the present invention to provide a mobile electrical device for disabling a moving vehicle. These and other objects, features, and advantages of the invention are provided by a projectile launched from a hand-operable air gun by a law enforcement officer.

The projectile includes a conductive front section including a housing having a substantially cylindrical shape and a centrally disposed longitudinal axis. Such a housing includes a conductive sleeve wrapped about an outer surface thereof and a rubber seal disposed about a proximal end portion thereof.

The device also includes a strike plate having a substantially annular shape and a conductive contact ring integral therewith wherein the strike plate is axially movable about the housing. Such a strike plate further has a plurality of apertures randomly spaced therethrough for advantageously reducing air-resistance exerted against the strike plate during operating conditions. The strike plate further includes a plurality of spike members electrically coupled to the contact ring and radially spaced along a perimeter thereof wherein the spike members extend forwardly and orthogonally from the strike plate.

The present invention also includes a conductive tip section removably attachable to the housing and disposed forwardly of the strike plate. Such a tip section includes a plurality of flange portions extending outwardly therefrom and being arranged in a substantially foxtail pattern so that the projectile can effectively remain engaged with a target after the tip section pierces an outer surface of the target.

The device further includes a mechanism for oscillating the strike plate along a selected path after a forward momentum is exerted onto the projectile. Such an oscillating mechanism is secured to the housing so that the spike members are advantageously caused to engage the target after the tip section engages the target. The oscillating mechanism preferably includes a plurality of elongated guide rails having opposed end portions connected to the housing and extending substantially parallel to the axis.

Such guide rails conveniently include a plurality of stop members for defining a maximum axial distance along which the strike plate may travel during operating conditions. The guide rails may be provided with a plurality of holes for respectively receiving pins therethrough, advantageously stopping the strike plate from moving beyond a selected point.

The oscillating mechanism may further include a plurality of helical spring members secured to the strike plate and disposed about the guide rails respectively. Such spring members are maintained at a compressed state during non-operating conditions, and are releasable from the compressed state after the projectile engages the target.

The present invention further includes a power supply source disposed within the housing and including wiring electrically coupled to the tip section and the strike members respectively. The power supply source preferably includes a plurality of batteries. Of course, alternate power supply sources well known in the industry may be used.

The device also includes a non-conductive rear section, preferably threadably connected to the front section and further including a rubber sleeve extending about an outer surface thereof. Such a rear section is removably attachable to the front section and is provided with a hollow channel extending substantially parallel to the axis wherein the air gun receives the projectile through the channel. The rear section preferably includes a plurality of fins pivotally attached to an outer surface thereof. Such fins are advantageously movable between raised and lowered positions for conveniently assisting a user to insert the projectile into the air gun.

The tip section defines a first electrode for distributing a positive charge to the target and the spike members define a plurality of second electrodes for respectively distributing a negative charge to the target. Such positive and negative electrodes generate an electric current for inducing a short circuit thereby disabling an electronic control module of the target upon impact.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
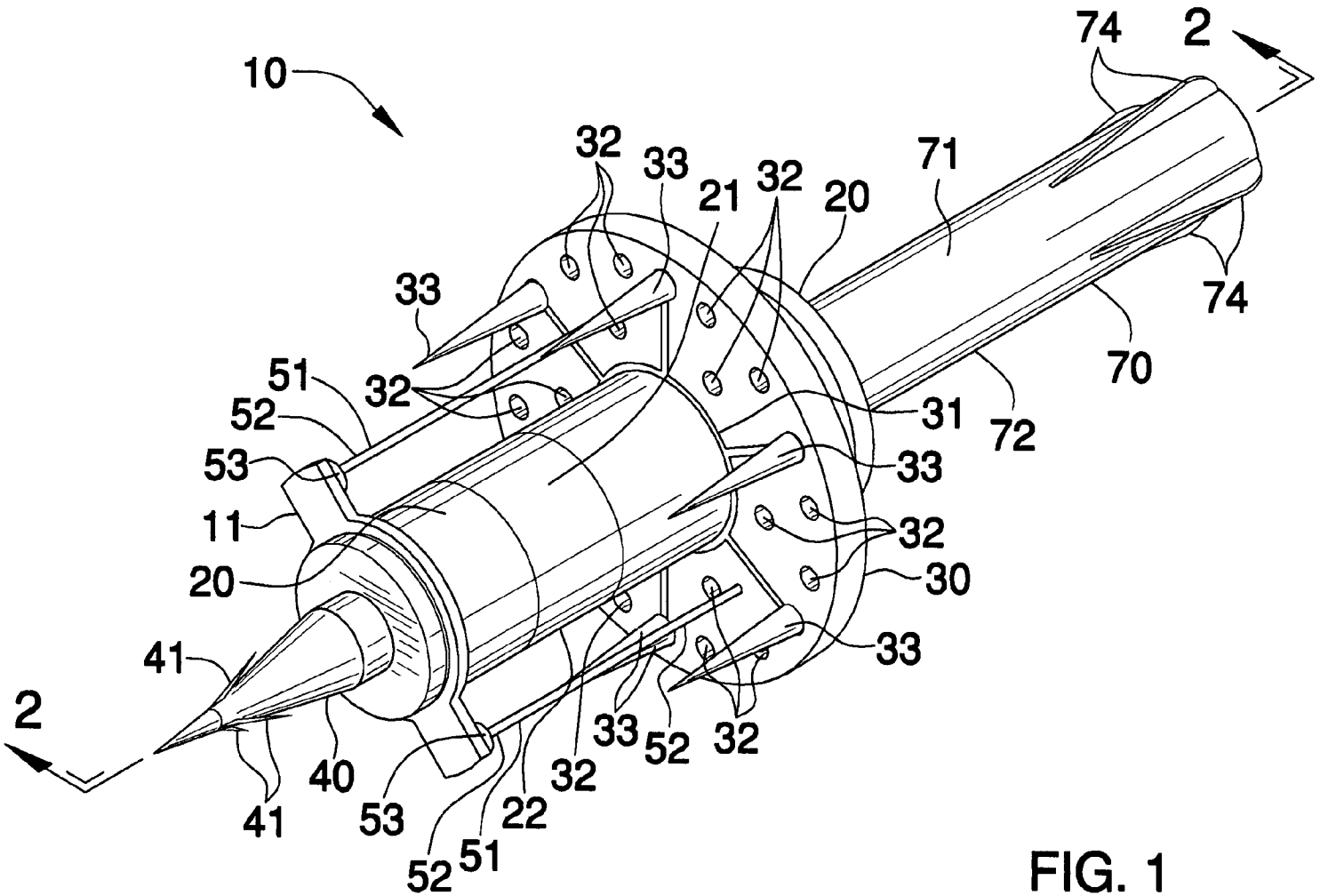
FIG. 1 is a perspective view showing a mobile electrical device for disabling a moving vehicle, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide a mobile electrical device for disabling a moving vehicle. It should be understood that the device 10 may be used to disable many different types of vehicles and should not be limited to only automobiles.

Referring initially to FIG. 1, the device 10 includes a conductive front section 11 including a housing 20 having a substantially cylindrical shape and a centrally disposed longitudinal axis. Such a housing 20 includes a conductive sleeve 21 wrapped about an outer surface 22 thereof and a rubber seal 23 disposed about a proximal end portion 24 thereof.

The device also includes a strike plate 30 having a substantially annular shape and a conductive contact ring 31 integral therewith wherein the strike plate 30 is axially movable about the housing 20. Such a strike plate 30 further has a plurality of apertures 32 randomly spaced therethrough for advantageously reducing air-resistance exerted against the strike plate 30 during operating conditions. This allows the projectile 10 to be launched through the air faster and more accurately than would be the case in the absence of the apertures 32. The strike plate 30 further includes a plurality of spike members 33 electrically coupled to the contact ring 31 and radially spaced along a perimeter thereof wherein the spike members 33 extend forwardly and orthogonally from the strike plate 30.

The present invention also includes a conductive tip section 40 removably attachable to the housing 20 and disposed forwardly of the strike plate 30. Such a tip section 40 includes a plurality of flange portions 41 extending outwardly therefrom and being arranged in a substantially foxtail pattern so that the projectile 10 can effectively remain engaged with a target (not shown) after the tip section 40 pierces an outer surface of the target. This feature ensures that the projectile 10 is not disabled after being fired and having engaged a vehicle.

Figure 2:
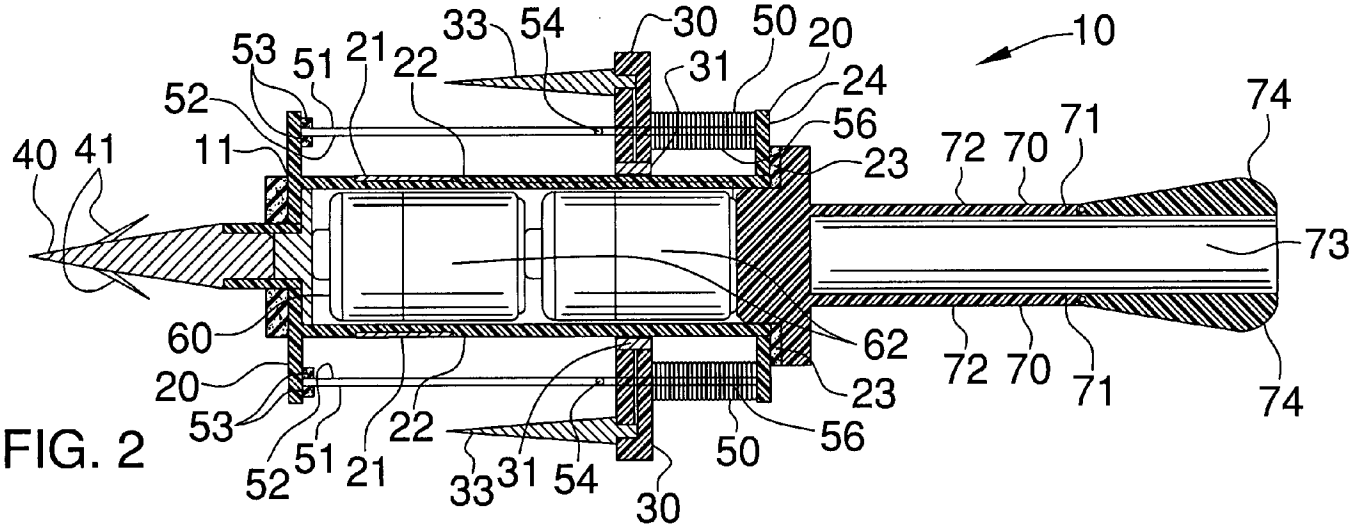
FIG. 2 is a cross-sectional view of the device shown in FIG. 1.
Figure 3:
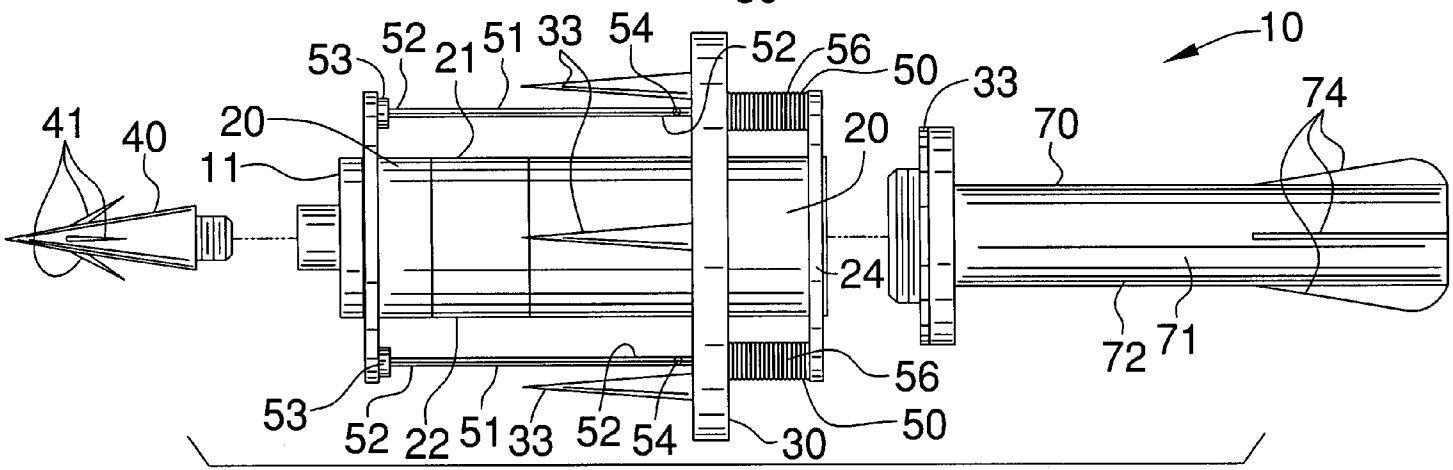
FIG. 3 is a partially exploded side elevational view of the device shown in FIG. 1.
Figure 4:
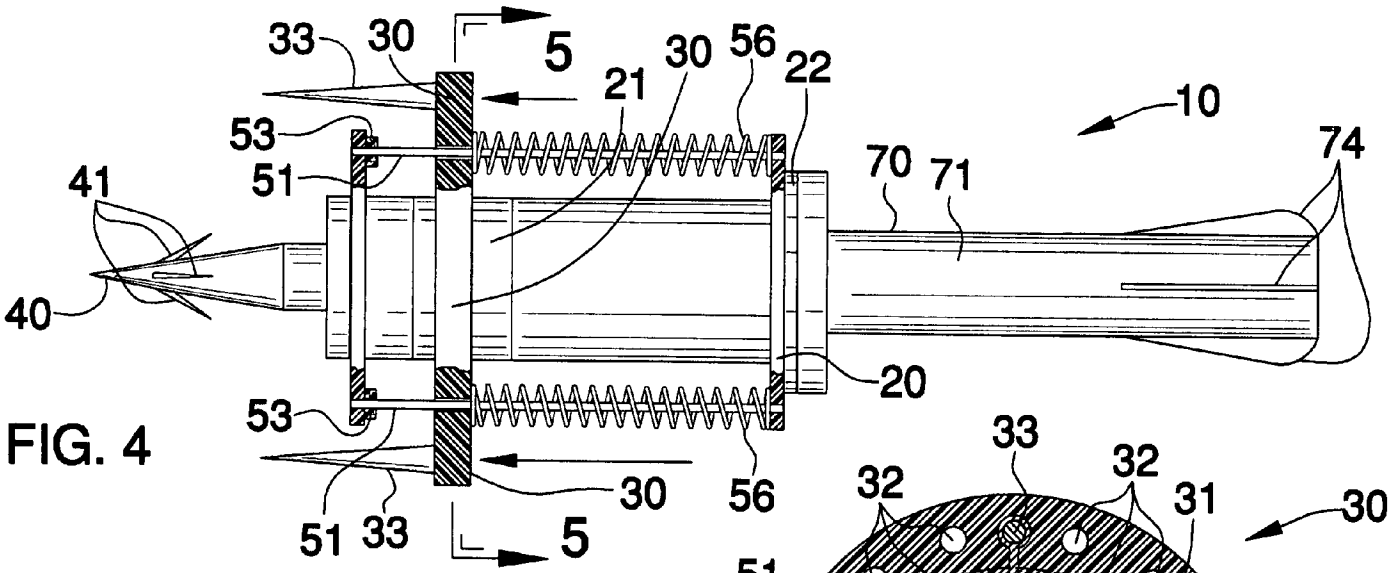
FIG. 4 is a side elevational view of the device shown in FIG. 1 with the strike plate and the oscillating mechanism at an extended position.
Figure 5:
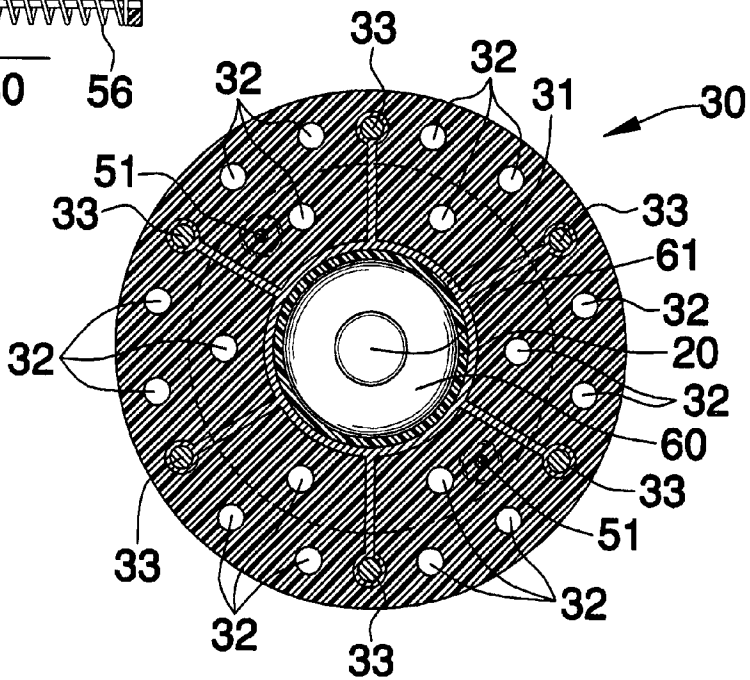
FIG. 5 is a cross-sectional view of the device shown in FIG. 4, taken along line 5—5.

As can be seen in FIGS. 2 and 4, the device 10 further includes a mechanism 50 for oscillating the strike plate 30 along a selected path after a forward momentum is exerted onto the projectile 10. Such an oscillating mechanism 50 is secured to the housing 20 so that the spike members 33 are advantageously caused to engage the target after the tip section 40 engages the target. The oscillating mechanism 50 includes a plurality of elongated guide rails 51 having opposed end portions 52 connected to the housing 20 and extending substantially parallel to the axis.

Such guide rails 51 conveniently include a plurality of stop members 53 for defining a maximum axial distance along which the strike plate 30 travels during operating conditions. The guide rails 51 are provided with a plurality of holes 54 for respectively receiving pins (not shown) therethrough, advantageously stopping the strike plate 30 from moving beyond a selected point.

The oscillating mechanism 50 further includes a plurality of helical spring members 56 secured to the strike plate 30 and disposed about the guide rails 51 respectively. Such spring members 56 are maintained at a compressed state during non-operating conditions, and are releasable from the compressed state after the projectile 10 engages the target. The force created by the disengaging spring members 56 advantageously forces the spike members 33 into the vehicle's outer surface, ensuring that the electrical circuit is complete.

The present invention further includes a power supply source 60 disposed within the housing 20 and including wiring electrically coupled to the tip section 40 and the spike members 33 respectively. The power supply source 60 includes a plurality of batteries 62. Of course, alternate power supply sources well known in the industry may be used.

The device 10 also includes a non-conductive rear section 70 threadably connected to the front section 11 and further including a rubber sleeve 71 extending about an outer surface 72 thereof. Such a rear section 70 is removably attachable to the front section 11 and is provided with a hollow channel 73 extending substantially parallel to the axis wherein the air gun (not shown) receives the projectile 10 through the channel 73.

The rear section 70 includes a plurality of fins 74 pivotally attached to an outer surface 72 thereof. Such fins 74 are advantageously movable between raised and lowered positions for conveniently assisting a user to insert the projectile 10 into the air gun. The fins 74 advantageously allow the projectile 10 to be launched along a straight path, similar to a dart traveling through the air for example.

The tip section 40 defines a first electrode for distributing a positive charge to the target and the spike members 33 define a plurality of second electrodes for respectively distributing a negative charge to the target. Such positive and negative electrodes generate an electric current for inducing a short circuit thereby disabling an electronic control module of the target upon impact.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A projectile for being launched from a hand-operable air gun by a law enforcement officer, said projectile comprising:

a conductive front section comprising a housing having a substantially cylindrical shape and a centrally disposed longitudinal axis, said housing including a conductive sleeve wrapped about an outer surface thereof, a strike plate having a substantially annular shape and including a conductive contact ring integral therewith wherein said strike plate is axially movable about said housing, said strike plate further having a plurality of apertures randomly spaced therethrough for reducing air-resistance exerted against said strike plate during operating conditions, said strike plate further comprising a plurality of spike members electrically coupled to said contact ring and radially spaced along a perimeter thereof;

a conductive tip section removably attachable to said housing and being disposed forwardly of said strike plate, said tip section comprising a plurality of flange portions extending outwardly therefrom and being arranged in a substantially foxtail pattern so that said projectile can remain effectively engaged with a target after said tip section pierces an outer surface of the target;

means for oscillating said strike plate along a selected path after a forward momentum is exerted onto said projectile, said oscillating means being secured to said housing so that said spike members are caused to engage the target after said tip section engages the target;

a power supply source disposed within said housing and including wiring electrically coupled to said tip section and said strike members respectively; and a non-conductive rear section removably attachable to said front section and being provided with a hollow channel extending substantially parallel to the axis wherein the air gun receives said projectile through the channel;

wherein said tip section defines a first electrode for distributing a positive charge to the target and said spike members define a plurality of second electrodes for respectively distributing a negative charge to the target, said positive and negative electrodes generating an electric current for inducing a short circuit and thereby disabling an electronic control module of the target upon impact.

2. The projectile of claim 1, wherein said power supply source comprises:

a plurality of batteries.

3. The projectile of claim 1, wherein said oscillating means comprises:

a plurality of elongated guide rails having opposed end portions connected to said housing an extending substantially parallel to the axis, said guide rails including a plurality of stop members for defining a maximum axial distance along which said strike plate may travel during operating conditions;

a plurality of helical spring members secured to said strike plate and disposed about said guide rails respectively, said spring members being maintained at a compressed state during non-operating conditions, said spring members being releasable from the compressed state after said projectile engages the target.

4. The projectile of claim 3, wherein said guide rails are provided with a plurality of holes for respectively receiving pins therethrough and stopping said strike plate from moving beyond a selected point.

5. The projectile of claim 1, wherein said rear section comprises: a plurality of fins pivotally attached to an outer surface thereof, said fins being movable between raised and lowered positions for assisting a user to insert said projectile into the air gun.

6. The projectile of claim 1, wherein said rear section is threadably connected to said front section.

7. A projectile for being launched from a hand-operable air gun by a law enforcement officer, said projectile comprising:

a conductive front section comprising a housing having a substantially cylindrical shape and a centrally disposed longitudinal axis, said housing including a conductive sleeve wrapped about an outer surface thereof, a strike plate having a substantially annular shape and including a conductive contact ring integral therewith wherein said strike plate is axially movable about said housing, said strike plate further having a plurality of apertures randomly spaced therethrough for reducing air-resistance exerted against said strike plate during operating conditions, said strike plate further comprising a plurality of spike members electrically coupled to said contact ring and radially spaced along a perimeter thereof;

a conductive tip section removably attachable to said housing and being disposed forwardly of said strike plate, said tip section comprising a plurality of flange portions extending outwardly therefrom and being arranged in a substantially foxtail pattern so that said projectile can remain effectively engaged with a target after said tip section pierces an outer surface of the target;

means for oscillating said strike plate along a selected path after a forward momentum is exerted onto said projectile, said oscillating means being secured to said housing so that said spike members are caused to engage the target after said tip section engages the target;

a power supply source disposed within said housing and including wiring electrically coupled to said tip section and said strike members respectively; and a non-conductive rear section including a rubber sleeve extending about an outer surface thereof, said rear section being removably attachable to said front section and being provided with a hollow channel extending substantially parallel to the axis wherein the air gun receives said projectile through the channel;

wherein said tip section defines a first electrode for distributing a positive charge to the target and said spike members define a plurality of second electrodes for respectively distributing a negative charge to the target, said positive and negative electrodes generating an electric current for inducing a short circuit and thereby disabling an electronic control module of the target upon impact.

8. The projectile of claim 7, wherein said power supply source comprises: a plurality of batteries.

9. The projectile of claim 7, wherein said oscillating means comprises:

a plurality of elongated guide rails having opposed end portions connected to said housing an extending substantially parallel to the axis, said guide rails including a plurality of stop members for defining a maximum axial distance along which said strike plate may travel during operating conditions;

a plurality of helical spring members secured to said strike plate and disposed about said guide rails respectively, said spring members being maintained at a compressed state during non-operating conditions, said spring members being releasable from the compressed state after said projectile engages the target.

10. The projectile of claim 9, wherein said guide rails are provided with a plurality of holes for respectively receiving pins therethrough and stopping said strike plate from moving beyond a selected point.

11. The projectile of claim 7, wherein said rear section comprises: a plurality of fins pivotally attached to an outer surface thereof, said fins being movable between raised and lowered positions for assisting a user to insert said projectile into the air gun.

12. The projectile of claim 7, wherein said rear section is threadably connected to said front section.

13. A projectile for being launched from a hand-operable air gun by a law enforcement officer, said projectile comprising:

a conductive front section comprising a housing having a substantially cylindrical shape and a centrally disposed longitudinal axis, said housing including a conductive sleeve wrapped about an outer surface thereof, said housing further including a rubber seal disposed about a proximal end portion thereof, a strike plate having a substantially annular shape and including a conductive contact ring integral therewith wherein said strike plate is axially movable about said housing, said strike plate further having a plurality of apertures randomly spaced therethrough for reducing air-resistance exerted against said strike plate during operating conditions, said strike plate further comprising a plurality of spike members electrically coupled to said contact ring and radially spaced along a perimeter thereof wherein said spike members extend forwardly and orthogonally from the strike plate;

a conductive tip section removably attachable to said housing and being disposed forwardly of said strike plate, said tip section comprising a plurality of flange portions extending outwardly therefrom and being arranged in a substantially foxtail pattern so that said projectile can remain effectively engaged with a target after said tip section pierces an outer surface of the target;

means for oscillating said strike plate along a selected path after a forward momentum is exerted onto said projectile, said oscillating means being secured to said housing so that said spike members are caused to engage the target after said tip section engages the target;

a power supply source disposed within said housing and including wiring electrically coupled to said tip section and said strike members respectively; and a non-conductive rear section including a rubber sleeve extending about an outer surface thereof, said rear section being removably attachable to said front section and being provided with a hollow channel extending substantially parallel to the axis wherein the air gun receives said projectile through the channel;

wherein said tip section defines a first electrode for distributing a positive charge to the target and said spike members define a plurality of second electrodes for respectively distributing a negative charge to the target, said positive and negative electrodes generating an electric current for inducing a short circuit and thereby disabling an electronic control module of the target upon impact.

14. The projectile of claim 13, wherein said power supply source comprises: a plurality of batteries.

15. The projectile of claim 13, wherein said oscillating means comprises:

a plurality of elongated guide rails having opposed end portions connected to said housing an extending substantially parallel to the axis, said guide rails including a plurality of stop members for defining a maximum axial distance along which said strike plate may travel during operating conditions;

a plurality of helical spring members secured to said strike plate and disposed about said guide rails respectively, said spring members being maintained at a compressed state during non-operating conditions, said spring members being releasable from the compressed state after said projectile engages the target.

16. The projectile of claim 15, wherein said guide rails are provided with a plurality of holes for respectively receiving pins therethrough and stopping said strike plate from moving beyond a selected point.

17. The projectile of claim 13, wherein said rear section comprises: a plurality of fins pivotally attached to an outer surface thereof, said fins being movable between raised and lowered positions for assisting a user to insert said projectile into the air gun.

18. The projectile of claim 13, wherein said rear section is threadably connected to said front section.

* * * * *